United States Patent [19]

Dixon et al.

[11] 4,126,195

[45] Nov. 21, 1978

[54] REPLACEABLE WEAR PAD FOR A ROCK BIT CUTTER YOKE

[75] Inventors: Robert L. Dixon, Brea; William J. Neilson, Whittier, both of Calif.

[73] Assignee: Smith International, Inc., Newport Beach, Calif.

[21] Appl. No.: 769,423

[22] Filed: Feb. 17, 1977

[51] Int. Cl.[2] ..... E21B 9/08

[52] U.S. Cl. ..... 175/364; 308/27

[58] Field of Search ..... 175/364, 363, 371, 362, 175/372, 361, 85 B, 367, 368–370, 354, 347; 308/27

[56] References Cited

U.S. PATENT DOCUMENTS

| | | | |
|---|---|---|---|
| 1,867,531 | 7/1932 | Reed | 175/367 X |
| 2,187,037 | 1/1940 | Kirkpatrick | 175/372 X |
| 3,389,760 | 6/1968 | Morris | 175/371 |
| 3,612,196 | 10/1971 | Dixon | 175/364 |
| 3,750,772 | 8/1973 | Venter | 174/364 |
| 3,835,944 | 9/1974 | Bingham | 175/364 |

*Primary Examiner*—Ernest R. Purser
*Assistant Examiner*—Richard E. Favreau
*Attorney, Agent, or Firm*—Christie, Parker & Hale

[57] ABSTRACT

A cutter assembly for a rotary head of a drilling machine comprises a yoke having a base for attachment to the rotary head, a pair of legs depending from the base, and an asymmetrical mounting hole through each leg, the hole being aligned with each other. A load pin extends between the legs of the yoke with the load pin being disposed within the holes. To prevent wear of the yoke during drilling, a replaceable wear pad is provided for each end of the load pin. Each pad is disposed between the load pin and the portion of the periphery of a mounting hole closest to the base. Thus, each wear pad is positioned at the loaded portion of the periphery of a mounting hole. Each wear pad extends around from about ⅓ to about ½ the circumference of the load pin.

11 Claims, 7 Drawing Figures

Fig. 3
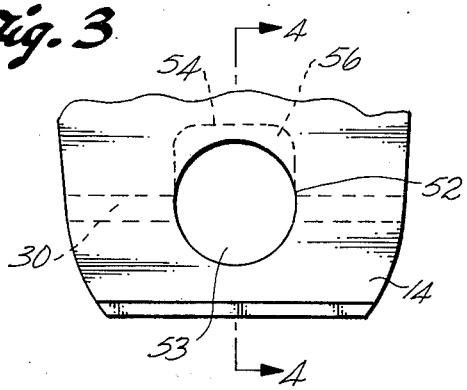
Fig. 4
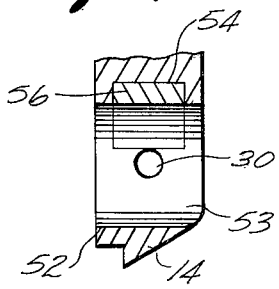
Fig. 5
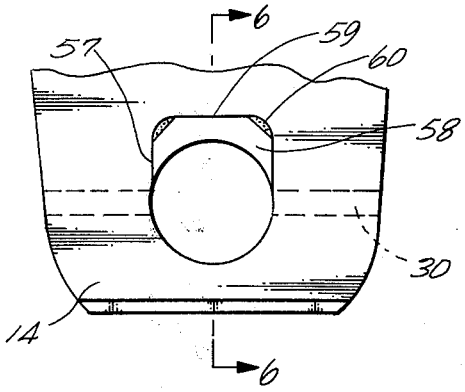
Fig. 6
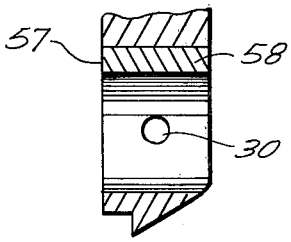
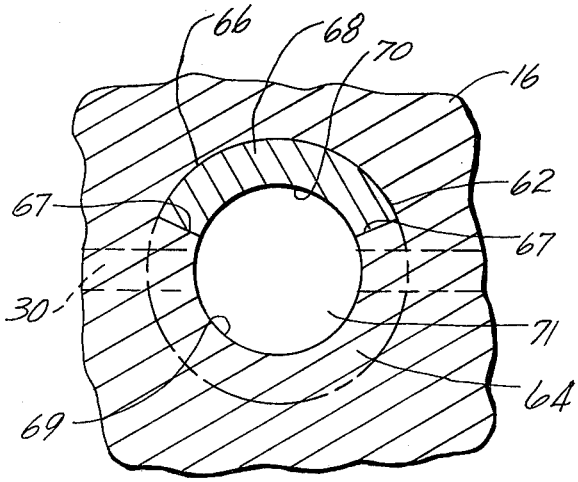
Fig. 7

REPLACEABLE WEAR PAD FOR A ROCK BIT CUTTER YOKE

BACKGROUND

Rock bits for a drilling machine used for forming big holes in tunnels in rock and other formations are described in U.S. Pat. Nos. 3,389,760, 3,658,141 and 3,786,879. Such bits can have a rotary head with a plurality of cutter assemblies mounted on the rotary head. Each cutter assembly can comprise a yoke having a base for attachment to the rotary head and a pair of legs depending from the base. Each cutter can be mounted on a load pin extending between the legs of the yoke, with the ends of the load pin being disposed within a pair of aligned openings in the legs.

In this type of drill bit the load of drilling is transmitted to the yoke via the load pin. Because of this load, fretting of the load pin and the legs of the yoke around the periphery of the mounting holes occurs. Due to this fretting, each load pin is usually replaced every second or third time the cutter mounted on the load pin is replaced.

It is desirable to avoid fretting of the yoke because the mounting holes for the load pin can become out of round. When they become out of round, it is necessary to cut off the old yoke and weld a new one on the rotary head. This is a costly and time consuming process.

To avoid such wear of the yoke, a full wear bushing can be placed in each opening in the yoke legs as described in U.S. Pat. No. 3,389,760. Segmented bushings have also been used to prevent wear. However, because the non-loaded portions of each leg at the end of the legs are inherently thin so they do not scrape against formation during drilling, only thin bushings have been used in the mounting holes to avoid undue weakening of the unloaded portion of the legs. Because a thin bushing is used, breakage of the loaded portion of the bushing can occur. This leaves the loaded portion of the yoke unprotected from fretting with resultant premature wear of the yoke necessitating costly and time consuming replacement.

Therefore, there is a need for a roller cutter assembly for a drill bit where the load pin of the roller cutter assembly is mounted between the legs of the yoke in such a way that fretting of the legs is avoided during drilling.

SUMMARY

This invention is for a roller cutter assembly having a load pin mounted in such a way as to avoid fretting. The roller cutter assembly comprises a yoke having a base for attachment to a rotary head and a pair of legs depending from the base with a mounting hole through each leg, the holes being aligned with each other. The load pin extends between the legs of the yoke with the load pin being disposed within the holes. To avoid wear and fretting of the load pin and the yoke during drilling, a replaceable wear pad is provided for each end of the load pin. The wear pad is disposed between the load pin and the loaded portion of the periphery of each hole, i.e., the portion of the periphery of each hole closest to the base. Each wear pad extends around from about ⅓ to about ½ of the circumference of the load pin.

Each mounting hole can be asymmetrical, having a pocket for placement of its respective wear pad, so the periphery of each hole adjacent to the pocket merges smoothly into the wear pad placed therein. This yields a symmetrical hole for mounting of the load pin.

In one version of the invention each wear pad is completely enclosed by its pocket and the load pin to prevent loss of the wear pad from its pocket during drilling. In another version of the invention each pocket extends all the way through its respective leg and each wear pad is held in its pocket by a press fit.

In another version of the invention the asymmetrical mounting hole can comprise a bore hole with a partial bushing or spacer mounted therein. Each partial bushing is secured to the portion of the periphery of the hole opposite the base and extends around the portion of the circumference of the load pin not enclosed by a wear pad. The radially inner surface of each wear pad merges smoothly with the radially inner surface of a partial bushing to provide a symmetrical hole for mounting of the load pin.

DRAWINGS

These and other features, aspects and advantages of the present invention will become more apparent upon consideration of the following description, appended claims, and accompanying drawings where:

FIG. 3 is a side elevation view of a portion of a leg of a roller cutter assembly having a wear pad in accordance with this invention;

FIG. 4 is a view along line 4—4 in FIG. 3;

FIG. 5 is a view like FIG. 3 showing another version of a wear pad;

FIG. 6 is a view along line 6—6 in FIG. 5; and

FIG. 7 is a view like FIG. 3 showing yet another version of a wear pad.

DESCRIPTION

Figure 2:
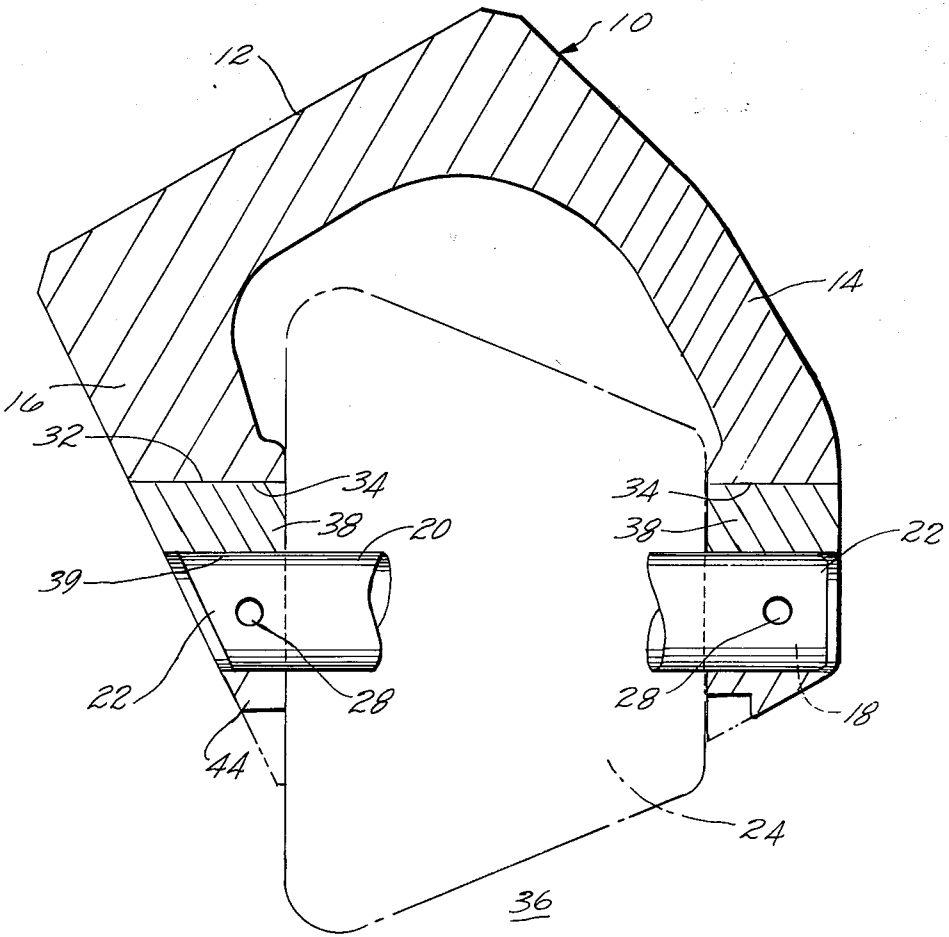
FIG. 2 is a view along line 2—2 of FIG. 1.
Figure 1:
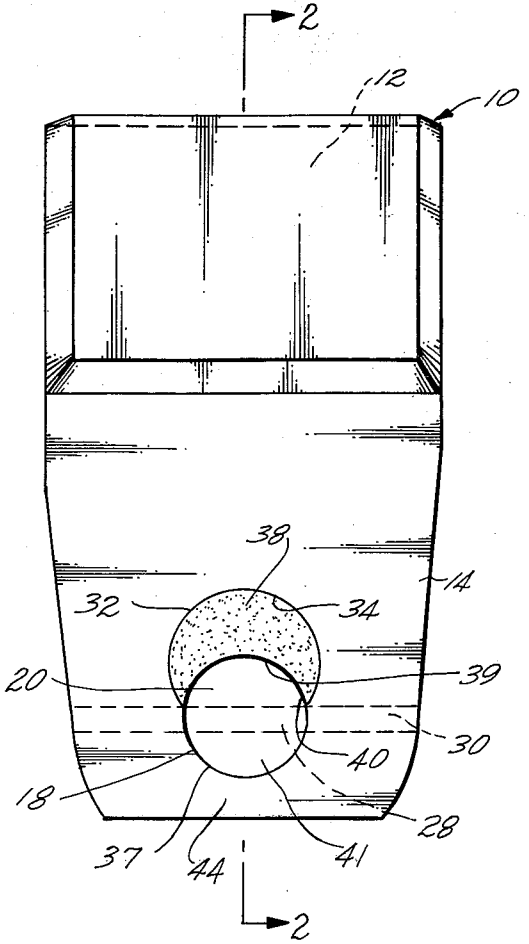
FIG. 1 is a side elevation view of a roller cutter assembly having a wear pad in accordance with this invention.

Referring to the drawings, FIGS. 1 and 2 show a yoke 10 for supporting a roller cutter of a drill bit. The yoke is generally U-shaped, having a flat rectangular base 12 and a pair of depending legs 14, 16. The yoke is mounted against a mounting surface of a rotary head (not shown) by pressing the base 12 against the mounting surface and welding the base and rotary head together around the complete periphery of the base. Preferably the mounting surface is normal to the direction of drilling so the axis of rotation of a cutter mounted in the yoke lies in a plane or is slightly skewed from a plane which intersects the axis of rotation of the rotary head during drilling.

There is an asymmetrical mounting hole 18 in each leg, the mounting holes being aligned with each other. A load pin 20 extends between the legs 14, 16. The ends 22 of the load pin are disposed within and extend through the mounting holes 18. A roller cutter 24, shown in phantom in FIG. 2, is mounted to rotate around the load pin 20. While the cutter 24 is illustrated for clarity as a smooth truncated cone, it will be recognized by one skilled in the art that such cutters have a plurality of hardened steel or tungsten carbide teeth for pulverizing rock. Each end of the load pin has a hole 28, which can be aligned with corresponding holes 30 through the legs 14, 16 of the yoke. When such holes are aligned, a split keeper or retainer pin (not shown) is driven into the holes to secure the load pin to the yoke.

Each mounting hole 18 comprises a slot or pocket 32 adjacent the load pin along the load bearing surface or periphery 34 of the mounting hole, i.e., the portion of the periphery of a mounting hole adjacent the load pin and opposite the surface 36 being drilled. It is this pocket which gives a mounting hole its asymmetry. The remainder 37 of a mounting hole is symmetrical, having the shape of a circular cylinder.

In the version of the invention shown in FIGS. 1 and 2, each pocket 32 is crescent-shaped and contains or houses a replaceable crescent-shaped wear pad 38. The purpose of the wear pads is to prevent fretting and wear of the yoke during drilling to avoid replacement of a yoke during the life of a drill bit.

The radially inner, concave surface 39 of each wear pad has substantially the same radius of curvature as does the symmetrical portion 37 of the mounting holes so the periphery 40 of each mounting hole adjacent its pocket merges continuously and smoothly into the wear pad placed therein. This yields a symmetrical, circular cylindrical hole 41 for mounting of the load pin to avoid abrasion and wear of the load pin during drilling. The wear pad can be made from the same material used for forming the yoke, or a harder material for improved wear resistance.

During drilling the load pin exerts load against the yoke around about $\frac{1}{3}$ of its circumference. Thus, as shown in the drawings, preferably each wear pad extends around at least about $\frac{1}{3}$ of the circumference of the load pin so the entire load bearing surface 34 of each mounting hole 18 is protected. However, preferably each wear pad extends around only up to about $\frac{1}{2}$ of the circumference of the load pin so the unloaded wall 44 of the legs are not thinned to accommodate the wear pad. Thinning is undesirable because it can lead to fracture of the legs during drilling.

The mounting hole 18 can be formed by boring through a leg in the conventional manner. The pocket 32 can then be formed by broaching or milling.

The wear pad 38 can be held in the pocket by means of a press fit or tack welding. When a press fit is used, interference between the wear pad and the pocket of about 0.005 inch is satisfactory. Typically, clearance of 0.01 inch is provided between the periphery of the load pin and both the wear pad and the surface of the mounting hole.

FIGS. 3 and 4 show a version of this invention not requiring welding or a press fit of the wear pad in the pocket to hold a wear pad in place. In this version of the invention, an asymmetrical mounting hole 52 is formed in a leg 14 by boring a circular cylindrical hole 53 through the leg and then milling a pocket 54 with a key mill so the pocket is surrounded on all sides by the leg 14 except adjacent the load pin. In assembling the roller cutter assembly a wear pad 56 conforming to the shape of the pocket 52 is placed into the pocket. Then a load pin (not shown) is inserted through the mounting holes, and held in place with a retainer pin (not shown). As long as the load pin remains in place, the wear pads cannot slide out of their respective pockets.

FIGS. 5 and 6 show another version of this invention substantially the same as the version shown in FIG. 1. The only difference is the shape of the pocket 56 and the wear pad 58 used. In the version of FIGS. 5 and 6, the wear pad is not crescent shaped, but rather has a flat rectangular base 59 with broken longitudinal corners 60. The wear pad is welded to the yoke along its broken corners. This version of the invention avoids the careful molding and machining required with a press fit.

With reference to FIG. 7, another way of providing an asymmetrical mounting hole is to bore a hole 62 of larger diameter than the diameter of the load pin in the end of a leg 16 of the yoke. Then a spacer or partial washer 64 can be mounted around from about $\frac{1}{2}$ to about $\frac{2}{3}$ of the unloaded portion of the periphery of the bore hole 62 and then welded thereto. This leaves a pocket 66 between the ends 67 of the partial washer. A wear pad 68 is placed in the pocket. The wear pad can be left loose or secured to the leg with tack welding or a spring pin. The wear pad 68 and the spacer 64 can be made of different materials. The radially inner surface 69 of the spacer 64 and the radially inner surface 70 of the wear pad 68 define a hole which is cylindrical in cross-section. The diameter of the hole is about 0.01 inch larger than the diameter of the load pin mounted therein. This version of the invention eliminates need for milling or broaching a slot for the wear pad.

Use of a wear pad for mounting a load pin in a roller cutter assembly for a drill bit in accordance with this invention has significant advantages compared to the use of a bushing. Because a wear pad does not extend to the unloaded thin portion of the leg of the yoke, a wear pad can be made as thick as desired without concern for undue weakening of the leg. This can result in increased life of the wear pad as compared to a bushing with resultant increased life of the load pin and the yoke assembly. This minimizes downtime of a drilling machine for replacement of roller cutter assemblies with resultant economies in the drilling operation.

Although this invention has been described in considerable detail with reference to certain versions thereof, other versions are within the scope of this invention. Therefore the spirit and scope of the appended claims should not necessarily be limited to the description of the preferred versions contained herein.

What is claimed is:

1. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising a replaceable wear pad for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling and in which each hole has a pocket for placement of a wear pad so the periphery of each hole adjacent the pocket merges smoothly into the wear pad placed therein.

2. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising a replaceable wear pad for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling, each hole having a pocket for placement of a wear pad so the periphery of each hole adjacent the pocket merges smoothly into the wear pad placed therein, and in which each wear pad is completely enclosed by such a pocket and the load pin to prevent loss of the wear pad during drilling.

3. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising a replaceable wear pad for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling, each hole having a pocket for placement of a wear pad so the periphery of each hole adjacent the pocket merges smoothly into the wear pad placed therein, and in which each wear pad is held in such a pocket by a press fit.

4. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising a replaceable wear pad for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling, each hole having a pocket for placement of a wear pad so the periphery of each hole adjacent the pocket merges smoothly into the wear pad placed therein, and in which the mounting hole comprises a bore hole through a leg of the yoke, and a partial bushing secured to the portion of the periphery of the bore hole farthest from the base of the yoke, wherein the partial bushing is secured to from about $\frac{1}{2}$ to about $\frac{2}{3}$ of the periphery of the bore hole.

5. A roller cutter assembly for a rotary head of a drilling machine comprising:

(a) a yoke having a base for attachment to the rotary head and a pair of legs depending from the base;

(b) a mounting hole through each leg, the holes being aligned with each other, the portion of the surface of each mounting hole closest to the base being loaded during drilling and the portion of the surface of each mounting hole opposed to the loaded portion being substantially unloaded during drilling, wherein the holes are asymmetrical toward their loaded surface, each mounting hole comprising a hole circular in cross section through a leg with a spacer mounted in said hole and secured to the non-loaded surface of said hole, each spacer extending around from about $\frac{1}{2}$ to about $\frac{2}{3}$ of the surface of said hole;

(c) a load pin extending between the legs of the yoke, the load pin being disposed within the mounting holes; and (d) a replaceable wear pad for each end of the load pin, each wear pad being disposed in the asymmetrical portion of a mounting hole, each wear pad extending around from about $\frac{1}{3}$ to about $\frac{1}{2}$ of the circumference of the load pin, wherein the radially inner surface of each wear pad and the surface of the mounting hole in which such wear pad is disposed define a hole having a radius slightly larger than the diameter of the load pin.

6. A roller cutter assembly for a rotary head of a drilling machine comprising a yoke having a base for attachment to the rotary head and a pair of legs depending from the base, a mounting hole through each leg and surrounded thereby, the holes being aligned with each other and each including a pocket and a load pin extending between the legs of the yoke, the load pin being disposed within the holes, the portions of the load pin disposed within the holes being substantially circular in cross section, the improvement comprising a replaceable wear pad for each end of the load pin, each wear pad being disposed between the load pin and the portion of the periphery of each hole closest to the base, and being completely enclosed by the respective pocket and the load pin to prevent loss of the wear pad during drilling, each wear pad extending around from about $\frac{1}{3}$ to about $\frac{1}{2}$ of the circumference of the load pin to prevent wear of the yoke during drilling.

7. A roller cutter assembly for a rotary head of a drilling machine, the cutter assembly comprising a yoke having a base for attachment to the rotary head and a pair of legs depending from the base, a mounting hole through each leg and surrounded thereby, the holes being aligned with each other and each including a pocket, and a load pin extending between the legs of the yoke, the load pin being disposed within the holes, the portions of the load pin disposed within the holes being substantially circular in cross section, the improvement comprising a replaceable wear pad press fitted into a respective pocket for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling.

8. In a roller cutter assembly for a rotary head of a drilling machine, the cutter assembly comprising a yoke having a base for attachment to the rotary head and a pair of legs depending from the base, a mounting hole through each leg and surrounded thereby, the holes being aligned with each other, and a load pin extending between the legs of the yoke, the load pin being disposed within the holes, the portions of the load pin disposed within the holes being substantially circular in cross section, the improvement comprising a crescent-shaped replaceable wear pad in a pocket for each end of the load pin, each wear pad being disposed between the load pin and the portion of the periphery of each hole closest to the base, each wear pad extending around from about $\frac{1}{3}$ to about $\frac{1}{2}$ of the circumference of the load pin to prevent wear of the yoke during drilling.

9. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising: a replaceable wear pad for each end of the load pin, each wear pad being disposed between the load pin and the portion of the periphery of each hole closest to the base, each wear pad extending around from about ⅓ to about ½ of the circumference of the load pin to prevent wear of the yoke during drilling; and two partial bushings, each of which is secured to the portion of the periphery of a mounting hole opposite the base, each partial bushing extending around the portion of the circumference of the load pin not extended around by a wear pad, wherein the radially inner surface of each wear pad merges smoothly with the radially inner surface of a partial bushing.

10. A roller cutter assembly for a rotary head of a drilling machine comprising:

(a) a yoke having a base for attachment to the rotary head and a pair of legs depending from the base;

(b) a mounting hole through each leg, the holes being aligned with each other, the portion of the surface of each mounting hole closest to the base being loaded during drilling and the portion of the surface of each mounting hole opposed to the loaded portion being substantially unloaded during drilling, wherein the holes are each asymmetrical and enlarged adjacent the loaded surface;

(c) a load pin extending between the legs of the yoke and an end portion of the load pin having a circular cross section being disposed within each of the mounting holes; and (d) a replaceable wear pad for each end of the load pin, each wear pad being disposed in the enlarged portion of a mounting hole, each wear pad extending around from about ⅓ to about ½ of the circumference of the load pin, wherein the radially inner surface of each wear pad and the surface of the mounting hole in which such wear pad is disposed define a circular hole having a radius slightly larger than the diameter of the load pin.

11. In a roller cutter assembly for a rotary head of a drilling machine, the cutter assembly comprising a yoke having a base for attachment to the rotary head and a pair of legs depending from the base, a mounting hole through each leg, the holes being aligned with each other, and a load pin extending between the legs of the yoke, the load pin being disposed within the holes, the improvement comprising a crescent-shaped replaceable wear pad for each end of the load pin, each wear pad being disposed between the load pin and the portion of the periphery of each hole closest to the base, each wear pad extending around from about ⅓ to about ½ of the circumference of the load pin to prevent wear of the yoke during drilling, each hole having a pocket for placement of a wear pad so the periphery of each hole adjacent the pocket merges smoothly into the wear pad placed therein.

* * * * *